US006446713B1

(12) United States Patent
Insalaco

(10) Patent No.: US 6,446,713 B1
(45) Date of Patent: Sep. 10, 2002

(54) HEAT EXCHANGER MANIFOLD

(75) Inventor: Jeffery Insalaco, Cocoa Beach, FL (US)

(73) Assignee: Norsk Hydro, A.S., Oslo (NO)

( * ) Notice: Subject to any disclaimer, the term of this patent is extended or adjusted under 35 U.S.C. 154(b) by 0 days.

(21) Appl. No.: 09/683,839

(22) Filed: Feb. 21, 2002

(51) Int. Cl.[7] ..... E28E 9/02
(52) U.S. Cl. ..... 165/173; 165/175
(58) Field of Search ..... 165/153, 173, 165/175, 176

(56) References Cited

U.S. PATENT DOCUMENTS 4,576,223 A * 3/1986 Humpolik et al. ..... 165/175
5,172,761 A * 12/1992 Lyon ..... 165/173
5,186,246 A * 2/1993 Halstead ..... 165/173
6,155,340 A * 12/2000 Folkedal et al. ..... 165/175
6,216,776 B1 * 4/2001 Kobayashi et al. ..... 165/173

* cited by examiner

*Primary Examiner*—Henry Bennett
*Assistant Examiner*—Terrell McKinnon
(74) *Attorney, Agent, or Firm*—Gary M. Hartman; Domenica N. S. Hartman

(57) ABSTRACT

A heat exchanger manifold comprising tank and header members secured together, each of the tank and header members having an interior surface facing the interior of the manifold. The header member comprises at least one raised surface feature on its interior surface so as to define longitudinal channels in the interior surface of the header member, and longitudinal passages within the manifold. One or more openings extend through the header plate and the raised surface feature. The width of at least one of the openings through the surface feature is less than the remainder of the opening, so that a portion of the surface feature defines a tube stop that limits the extent to which a tube received in the opening can extend into the interior of the manifold.

20 Claims, 3 Drawing Sheets

HEAT EXCHANGER MANIFOLD

BACKGROUND OF INVENTION

1. Field of the Invention

The present invention generally relates to heat exchangers comprising tubes that carry a coolant or other heat transfer medium to and from a pair of manifolds, such as those of the type used as evaporators in automobile air-conditioning systems. More particularly, this invention relates a heat exchanger manifold comprising a tank plate and a header plate in which tube ports are formed, and in which ribs are present on the interior of the header plate to define tube stops that positively locate the ends of the tubes within the manifold.

2. Description of the Related Art

Heat exchangers are employed within the automotive industry as condensers and evaporators for use in air conditioning systems, radiators for cooling engine coolant, and heater cores for internal climate control. In order to efficiently maximize the amount of surface area available for transferring heat between the environment and a fluid flowing through the heat exchanger, heat exchanger designs are typically of a tube-and-fin type in which numerous tubes thermally communicate with high surface area fins. The fins enhance the ability of the heat exchanger to transfer heat from the fluid to the environment, or vice versa. For example, heat exchangers used the automotive industry as air conditioner evaporators serve to vaporize a refrigerant by transferring heat from air forced over the external surfaces of the evaporator to the refrigerant flowing through the evaporator.

One type of heat exchanger used in the automotive industry is constructed of a number of parallel tubes that are joined to and between a pair of manifolds, creating a parallel flow arrangement. An internal passage within each manifold defines a reservoir that is in fluidic communication with tubes through tube ports, e.g., holes or slots, formed in the manifold. One or both manifolds include one or more inlet and outlet ports through which a heat transfer fluid enters and exits the heat exchanger. To promote thermal efficiency, such heat exchangers have been constructed by soldering or brazing the tubes to their respective ports. Finally, fins are provided in the form of panels having apertures through which the tubes are inserted, or in the form of sinusoidal centers that can be positioned between adjacent pairs oblong or "flat" tubes. A notable flat tube design is known as a microtube, whose oval shape accommodates a row of small parallel passages separated walls (webs) formed integrally with the microtube, such that heat transfer is enhanced by increasing the surface area in contact with the heat transfer fluid.

Various manifold constructions have been suggested. Tubular manifolds with a circular cross-section have typically been preferred for use in high pressure applications, such as evaporators and condensers. However, tubular manifolds are relatively difficult to punch or pierce in order form tube ports. Two-piece manifolds that comprise a tank plate and header plate overcome this problem by locating the tube ports in the header which can be relatively flat to facilitate piercing or punching. The header plate is then mechanically or metallurgically secured to the tank plate to define a passage that fluidically communicates with the tube ports. To increase heat transfer (by improving refrigerant distribution) and the high strength of the manifold, either or both of the tank and header plates can be formed to have multiple channels such that the resulting two-piece manifold has multiple parallel internal passages extending the length of the manifold.

The end of a tube can restrict flow through a manifold if the tube is installed too far into its tube port, and may block flow entirely if the end contacts the tank plate. For this reason, either the tank plate or the tubes are typically formed to define tube stops that positively locate the ends the tubes within the manifold. An example is disclosed in commonly-assigned U.S. Pat. No. 6,155,340 to Folkedal et al., which makes use of a one-piece extruded manifold in which multiple parallel passages are defined. Each passage has a substantially circular shape and is separated from adjacent passages by walls, which also extend along the length of the manifold. Tube ports are formed by machining holes through one surface of the manifold and partially through the walls that separate the passages. The portions of the walls that remain serve as integral tube stops, limiting the extent to which the tubes can be inserted into the manifold so as to prevent the tube ends from excessively restricting the flow of heat transfer fluid through the passages. Other types of tube stops formed by raised surface features on the tank plate of a two-piece manifold are also known, as shown U.S. Pat. Nos. 4,971,145 and 5,172,761.

A difficulty encountered with manifolds having integral tube stops is the cost and practicality of production in very large quantities. A heat exchanger, manifold that makes possible a simplified process of forming tube ports and tube stops would be desirable.

SUMMARY OF INVENTION

The present invention provides a heat exchanger manifold comprising tank and header members secured together to define an interior of the manifold, with openings formed in the header member to receive heat exchanger tubes, and with tube stops for the tubes defined by raised surface features on the interior surface of the header member, as opposed to the tank member.

The tank and header members of this invention have interior surfaces that face each other and the interior of the manifold. The header member comprises a base portion and at least one raised surface feature rising therefrom that define the interior surface of the header member. The feature is oriented parallel to the longitudinal length of the manifold so as to define at least two longitudinal channels in the interior surface of the member. When the tank and header members are assembled, the surface feature of the header member preferably contacts the interior surface the tank member, so that the channels in the header member define longitudinal passages within the interior of the manifold. One or more openings extend through the base portion of the header member and through at least a portion of the surface feature. The openings are sized to receive tubes with ends having complementary shapes to that of the openings.

According to the invention, the extent to which a tube received in one of the openings can extend into the interior of the manifold is determined at least in part by the width of the opening through the surface feature. This portion of the opening defines what is termed herein a transverse gap that separates opposing portions of the surface feature defined by the opening. If the transverse gap in the surface feature has a width that is less than the width of the remainder of the opening through the base portion, at least one of the opposing portions of the surface feature will be present in the opening, creating a step in the size of the opening. A tube fully inserted into such an opening will abut the portion (step) and thus be prevented from contacting the interior surface of the tank member. As a result, there exists a standoff gap between the end of the tube and the interior surface of the tank member through which a heat transfer fluid is able flow between the end of the tube and the passages within the manifold. Furthermore, the transverse gap formed by the opening through the surface feature allows the heat transfer fluid to flow between the end of the tube and each of the manifold passages. On the other hand, if the opening has a uniform width through the header member and its surface feature, i.e., the width of the transverse gap is the same as the width of the opening, a tube can be inserted into the opening without encountering a tube stop. In this case, the tube can be inserted until it abuts the interior surface of the tank member, with the result that the end of the tube defines a baffle that may restrict or divert flow through the manifold.

From the above, it can be appreciated that as long as a portion of the raised surface feature remains in the opening in the header member, a step is present that provides a tube stop for a tube inserted into the opening. The width of the opening through the raised surface feature and the distance of the step from the interior surface of the tank member determine the widths of the transverse and standoff gaps, respectively. Flow distribution of the heat transfer fluid within the manifold can be altered by varying the widths of these gaps to promote flow through any one of the passages. For example, the width of the transverse gap through the surface feature can be tailored to promote flow toward either of the manifold passages. In this manner, flow can be promoted to the front and then the back of the heat exchanger in alternate tubes, thereby optimizing flow through the heat exchanger. If the tubes are microtubes that are brazed in the openings, the stops can also have the beneficial effect of inhibiting the flow of brazing material into the small parallel passages of the microtubes, thereby reducing the risk that the microtube passages will become plugged by the brazing material.

From the above, it can also be seen that the manifold of this invention can make use of an uncomplicated die and punching operation to simultaneously produce the openings in the header member and tube stops for tubes inserted in the openings. A significant aspect of the invention is the ability to produce the header member by extrusion, taking advantage of the two-dimensional aspects of extrusion technology to mass produce a header member that largely defines the manifold passages and provides the structural integrity of the manifold. As a result, the tank member can have an uncomplicated plate-shaped configuration that can be formed by stamping or any other suitable process. Optionally, the tank member can be fabricated to have one or more raised surface features located and sized to block one or more of the channels in the header member, thereby defining baffles within the longitudinal passages of the manifold. The raised surface features can formed in the tank member to provide any number of baffles that can be to alter the refrigerant flow and distribution within the manifold.

Other objects and advantages of this invention will be better appreciated from the following detailed description.

DETAILED DESCRIPTION

Figure 1:
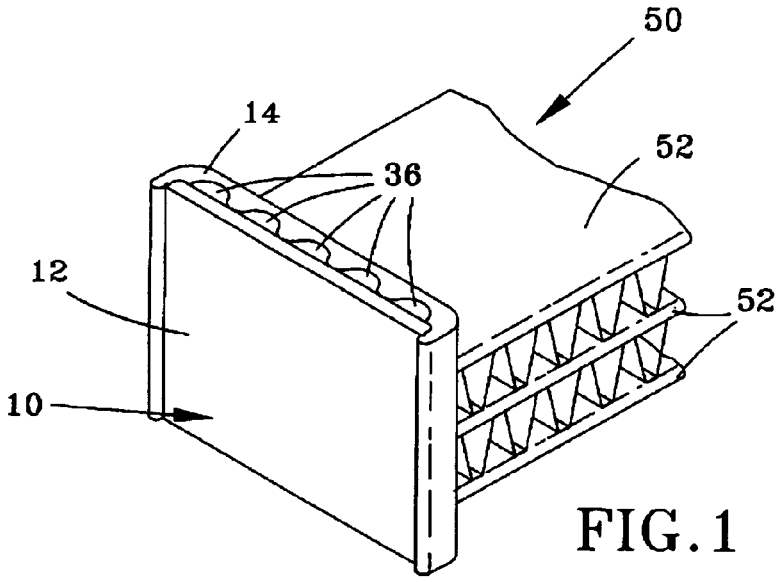
FIG. 1 is a partial perspective view of a heat exchanger assembly utilizing a manifold comprising a tank plate and header plate in accordance with a preferred embodiment of the present invention.
Figure 2:
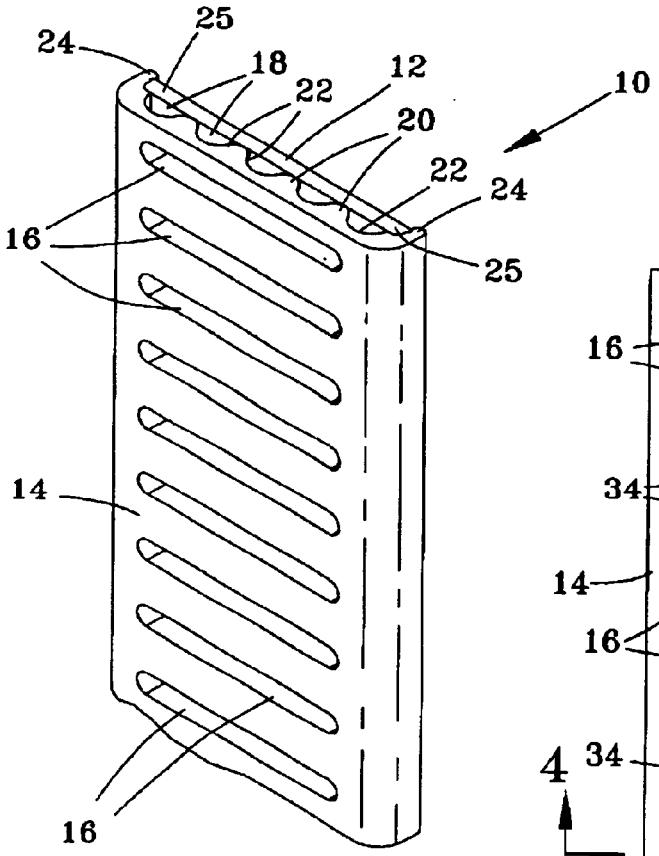
FIG. 2 is a perspective view of the manifold of FIG. 1.

A manifold 10 configured in accordance with this invention is represented in FIG. 2, and shown in FIG. 1 assembled in a heat exchanger 50. The heat exchanger 50 is of a tube-and-center type used as evaporators for automotive air-conditioning systems, though other applications are within the scope of the invention. The heat exchanger 50 is shown with tubes 52 geometrically and hydraulically in parallel with each other though a serpentine tube configuration could also be used. The tubes 52 are represented as being flat, such as a microtube that can be extruded to have multiple internal passages. A suitable fluid, such as for example a refrigerant, flows through the tubes 52 between the manifold 10 and a second manifold (not shown), which may have the same configuration as the manifold 10.

The heat exchanger 50 is represented in FIG. 1 as having a monolithic construction, in which the entire heat exchanger 50 is preferably brazed or soldered together in a single operation. For this purpose, the components of the heat exchanger 50 are preferably formed from a suitable aluminum alloy, such as aluminum alloy AA 3003 or 6005, as designated by the Aluminum Association (AA), though other aluminum alloys could be used. To further facilitate assembly and joining, some or all of the components of the heat exchanger 50 may be formed from a clad aluminum alloy. For example, the components can be formed to have a core formed of AA 3003 which is clad with a suitable braze alloy, such as aluminum-silicon eutectic brazing alloys AA 4045, AA 4047 and AA 4343, or a zinc-aluminum alloy for soldering operations. As a result, the cladding temperature has a lower melting temperature than the AA 3003 core material, and can therefore flow to form brazements or solder joints at temperatures that will not damage the heat exchanger 50.

The manifold 10 is shown in FIG. 2 as a subassembly comprising a tank plate 12 and a header plate 14. Each of the manifold 10, tank plate 12 and header plate 14 generally has a longitudinal length in the direction of the row of tubes 52 shown in FIG. 1, and a lateral width transverse to its longitudinal length. The tank plate 12 is shown as having a generally planar shape and the header plate 14 is shown as having a generally U-shaped cross-section, though other configurations are possible. In the configurations shown, the tank plate 12 can be formed by stamping, while the header plate 14 can be formed by extrusion, though other fabrication methods could be used. Slots 16 are formed in the header plate 14 to serve as tube ports for the tubes 52 shown in FIG. 1, with each slot 16 sized to receive one end of a tube 52. Each slot 16 extends through a base wall 26 of the header plate 14 (FIGS. 4 through 7) to fluidically connect one or more cooling passages within the tube 52 to an interior region of the manifold 10 defined between the tank and header plates 12 and 14.

The interior region of the manifold 10 is interrupted by four longitudinally-extending raised portions or ribs 20 defined by the interior surface of the header plate 14. Each adjacent pair of ribs 20 defines a channel 22 in the interior surface of the header plate 14. In FIG. 2, the interior surface of the header plate 14 is represented as having a sinusoidal shape with the ribs 20 and channels 22 being defined by peaks and valleys the of sinusoidal surface form. The crests of the ribs 20 are shown as contacting the tank plate 12 so as to divide the interior region of the manifold 10 into five separate and parallel internal chambers or passages 18, with each channel 22 and the opposing interior surface of the tank plate 12 defining one of the passages 18. Alternatively, the tubs 20 could be formed so as not to contact the tank plate 12, such that the passages 18 fluidically communicate with each other through gaps between the ribs 20 and the tank plate 12. The ribs 20 preferably extend the entire length of the manifold 10, such that the channels 22 (and therefore the passages 18) also extend the entire length of the manifold 10 unless interrupted by a baffle, as will be discussed below. The passages 18 can be seen to have a semicircular cross-section in FIG. 2 as a result of the planar interior surface of the tank member 12 and the arcuate shape of the channels 22, though other cross-sectional shapes are foreseeable for the passages 18. When used in combination with the multiport tubes 52 of FIG. 1, individual passages within the tubes 52 can be fluidically connected to one or more of the passages 18 of the manifold 10. The header plate 14 can be configured so that the manifold 10 has any desired number of passages 18, which may or may not correspond to the number of passages in the tubes 52.

The header plate 14 is shown as being mechanically secured to the tank plate 12 as a result of the lateral edges 25 of the tank plate 12 being engaged by ears 24 defined by the lateral edges of the header plate 14. In the preferred embodiment of the invention, the operation of brazing or soldering the tank and header plates 12 and 14 together also serves to braze or solder each rib 20 to the tank plate 12, forming a fluid-tight joint with the interior surface of the tank plate 12. For this purpose, the interior surface of the tank plate 12 is preferably clad with a braze or solder material, though suitable solder or braze materials could be provided in other forms.

Figure 3:
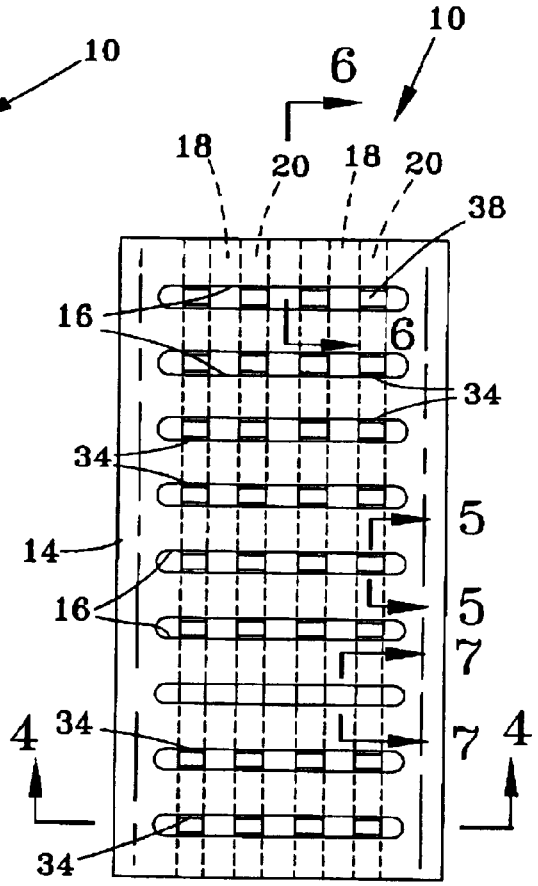
FIG. 3 is a plan view of the manifold of FIGS. 1 and 2.
Figure 4:
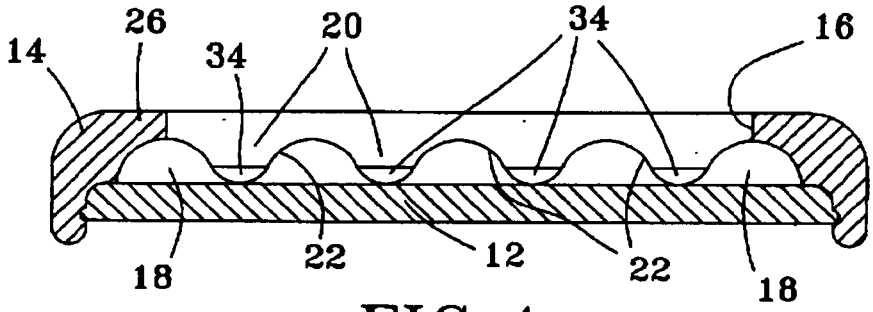
FIGS. 4, 5, 6 and 7 are cross-sectional views of the manifold in FIG. 3.
Figure 5:
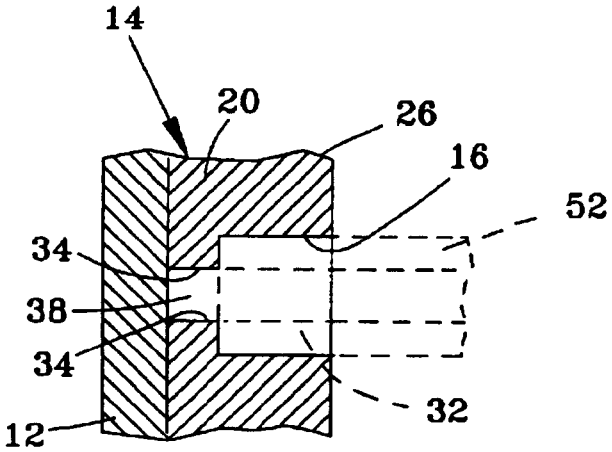
Figure 6:
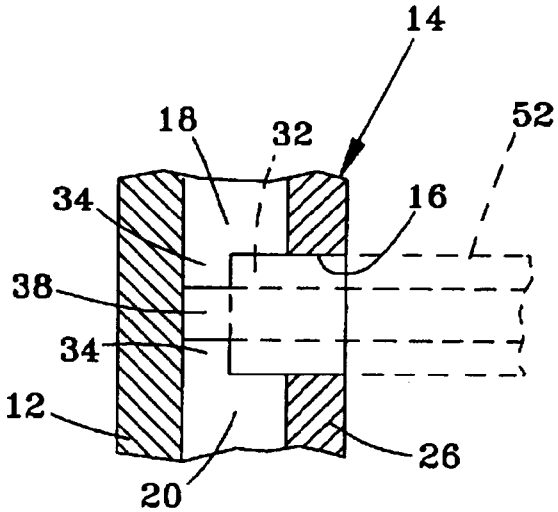
Figure 7:
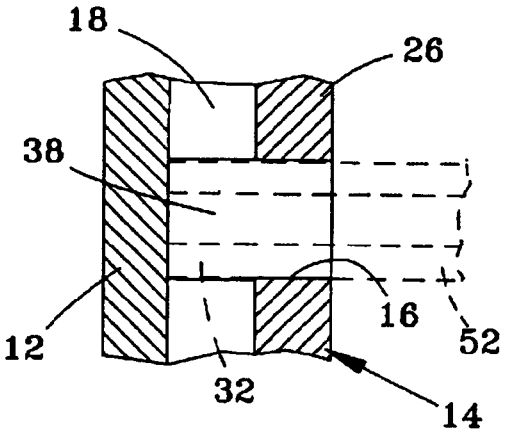

FIG. 3 is a view of the manifold 10 looking toward the slots with FIGS. 4 through 7 being different sectional views of the manifold 10. As seen in FIGS. 3 and 4, the slots 16 in the header plate 14 are formed entirely through the base wall 26 of the header plate 14, and also through the ribs 20 extending inward from the base wall 26. However, FIGS. 4, 5 and 6 show the width of the slot 16 through the base wall 26 as being greater than the width of the slot 16 through the ribs 20. As a result, opposing portions 34 of the ribs 20, separated by a transverse gap 38, are visible in FIG. 3, and project laterally inward beneath the lateral edges of slot 16 through the base wall 26, thereby defining steps in the opening of slot 16. These opposing portions 34 serve as tube stops for the tubes 52 in phantom in FIGS. 5 and 6. The transverse gaps 38 allow heat fluid to flow between a tube 52 and each of the manifold passages 18. The distance that the end 32 of a tube 52 is spaced from the interior wall the tank plate 12, referred herein as a standoff gap, can be tailored by controlling the distance from the crest of the rib 20 of the step defined by the opposing portions 34 of the rib 20 remaining in the slot 16. In practice, half of the height of each rib 20 can be removed to provide an adequate cross-sectional flow area through the passages 18 of the manifold FIG. 7 is a sectional view through a slot 16 formed in the header plate 14 that differs from the other slots 16 as a result of the width of the slot 16 being constant through the base wall 26 and the ribs 20. In other words, the width of the transverse gap 38 is essentially equal to the width of the slot 16 through the base wall 26. As a result, portions of the ribs 20 are not visible in FIG. 3 through the slot 16 depicted in FIG. 7. Without portions of the ribs 20 to serve as tube stops for a tube 52 (indicated in phantom in FIG. 7), the end 32 of the tube 52 abuts the interior wall of the tank plate 12, such that the tube end 32 functions as a baffle for altering the flow through the heat exchanger 50.

Figure 8:
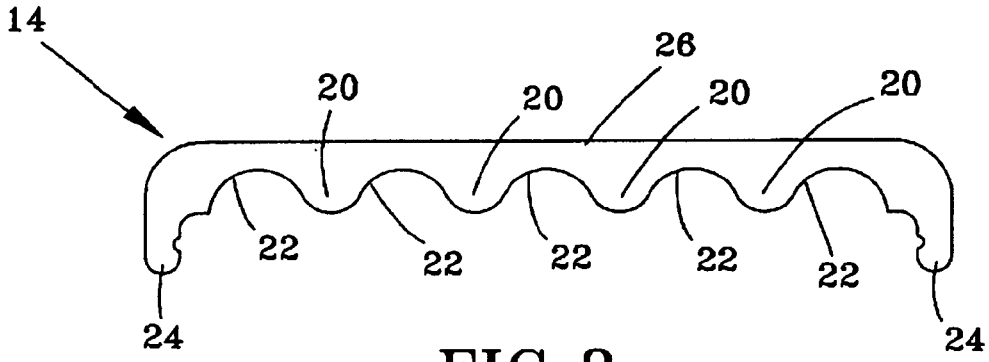
FIG. 8 is an end view of the header plate of the manifold.
Figure 9:
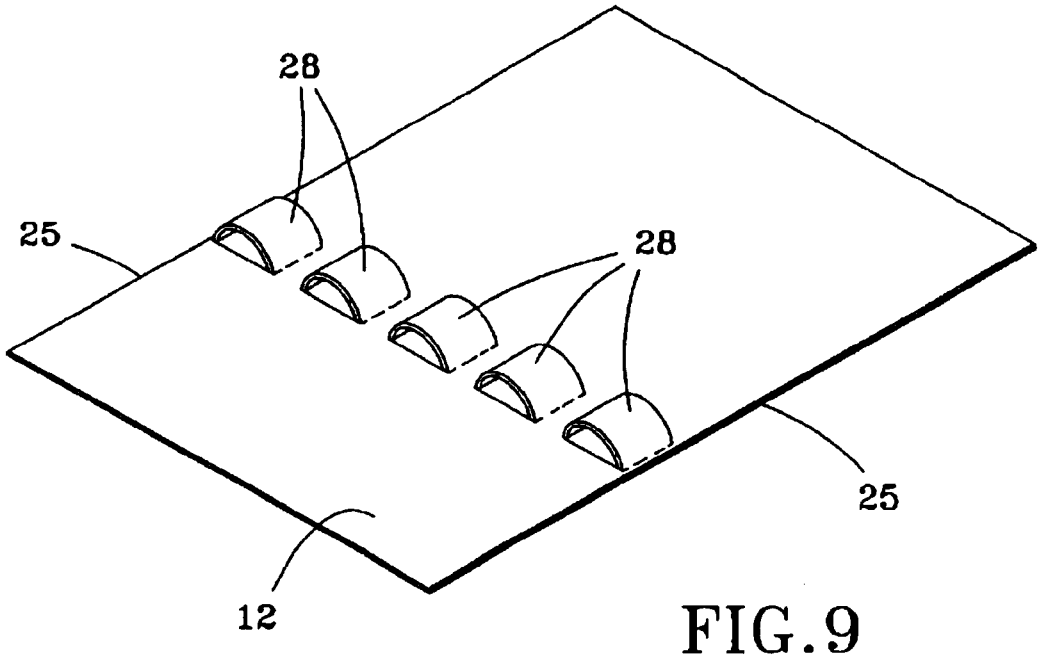
FIG. 9 is a perspective view of the tank plate of the manifold shown in FIGS. 1 and 2 in accordance with an embodiment of the invention.
Figure 10:
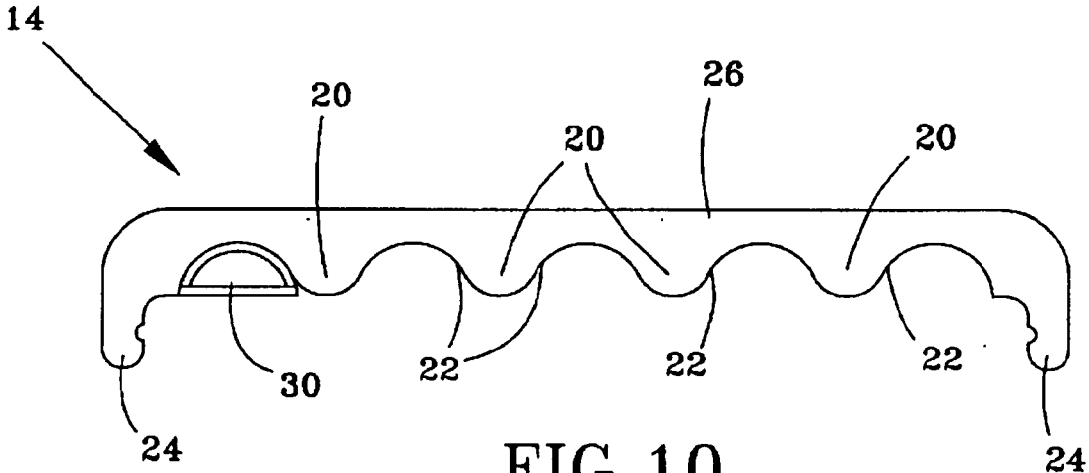
FIG. 10 is an end view of the header plate of FIG. 8 incorporating a baffle in accordance with another embodiment of the invention.

FIGS. 8, 9 and 10 represent two techniques by which baffles can be provided within the passages 18, in lieu of or in addition to the technique represented in FIGS. 3 and 7. In FIG. 9, the tank plate 12 is shown as having been stamped to define integral raised baffles 28 on its interior surface. When the tank plate 12 is assembled with the header plate 14 shown in FIG. 8, the baffles 28 are received in the channels 22 of the header plate 14 and block the passages 18. Brazing the tank and header plates 12 and 14 as discussed above results in the baffles 28 forming a fluid-tight joint with the channels 22. In FIG. 10, a discrete baffle member 30 is formed separately of the tank and head plates 12 and 14, such as by stamping. The baffle member 30 is shown as having been pressed or otherwise retained in one of the channels 22 of the header plate 14. Again, brazing the tank and header plates 12 and 14 as discussed above preferably results in the baffle 30 forming fluid-tight metallurgical joints with the interior surfaces of the tank and header plates 12 and 14. For this purpose, the baffle member 30 can be clad with a suitable braze or solder material. End plugs 36 shown in FIG. 1 as closing the ends of the passages 18 can be produced and installed in the manifold 10 in a manner similar to the baffle member 30.

The slots 16 can be formed in the header plate 12 by various known methods. In a preferred embodiment, a punching operation is performed from the exterior surface of the header plate 14 with a punch appropriately shaped to form the portion of the slot 16 through the base wall 26 and the transverse gap 38 defined by the slot 16 through the ribs 20. As a result a single punching operation serves to simultaneously form tube ports (slots 16) and tube stops (rib portions 34) in the header plate 14. The pressure applied to the interior surface of the header plate 14 during the punching operation can have the additional benefit of truing up the interior dimensions of the header plate 14, thereby facilitating the installation of the baffles 28 and 30 and plugs 36 in the passages 18, and facilitating the clinching of the lateral edges 25 of the tank plate 12 with the ears 24 of the header plate 14.

While the invention has been described in terms of a preferred embodiment, it is apparent that other forms could be adopted by one skilled in the art. For example, materials and processes other than those noted above could be adopted, and the manifold and heat exchanger could be modified from that shown in the Figures in order to be suitable for a variety of applications. Accordingly, the scope of the invention is to be limited only by following claims.

What is claimed is:

1. An evaporator having a pair of manifolds and tubes fluidically connected to each of the manifolds for carrying a fluid to and from the manifolds, at least one of the manifolds comprising:

a tank member comprising a substantially planar plate having an interior surface facing the interior of the manifold and having a pair of oppositely-dispose disposed lateral edges;

a header member having a pair of oppositely-disposed lateral edges joined to the lateral edges of the tank member to define the interior ofthe manifold, the header memberhaving an interior surface facing the interior of the manifold and the interior surface of the tank member, the header member comprising a base wall and at least one longitudinal rib projecting from the base wall and extending substantially the entire longitudinal length of the manifold so as to define first and second longitudinal channels in the interior surface of the header member, the rib contacting the interior surface of the tank member so that the first and second longitudinal channels define first and second longitudinal passages within the interior of the manifold; and openings through the base wall and the rib of the header member, at least one of the openings having a first width through the base wall and a second width through the rib that is less than the first width, such that opposing portions of the rib extend into the at least one opening;

wherein a first of the tubes is received in at least one opening so as to be in fluidic communication with the first and second passages of the manifold, the first tube abutting the opposing portions of the rib.

2. An evaporator according to claim 1, wherein a second of the openings has a substantially constant width through the base wall and the rib, a second of the tubes is received in the second opening and abuts the interior surface of the tank member, and an end portion of the second tube defines a baffle within at least one of the passages.

3. An evaporator according to claim 1, further comprising at least one baffle within at least one of the passages, the at least one baffle being a raised surface feature defined on the interior surface of the tank member.

4. An evaporator according to claim 1, further comprising at least one baffle within at least one of the passages, the at least one baffle being a discrete member disposed within one of the first and second longitudinal channels of the header member and attached to the interior surface of the tank member and the header member.

5. An evaporator according to claim 1, wherein the header member has at least two of the ribs.

6. An evaporator according to claim 1, wherein each of the passages has a semicircular cross-section.

7. An evaporator according to claim 1, wherein the rib is metallurgically bonded to the interior surface of the tank member.

8. An evaporator according to claim 1, wherein each of the tubes is a multiport tube having at least a first passage fluidically communicating with the first passage of the manifold and at least a second passage fluidically communicating with the second passage of the manifold.

9. A heat exchanger manifold having a longitudinal length and a lateral width, the manifold comprising:

a tank member having an interior surface facing the interior of the manifold; a header member assembled with the tank member and having an interior surface facing the interior of the manifold and the interior surface the tank member, the header member comprising a base wall and at least one raised surface feature on the base wall and oriented parallel to the longitudinal length of the manifold so as to define first and second longitudinal channels in the interior surface of the header member, the first second channels defining first and second longitudinal passages within interior of the manifold; and an opening through the base wall and a portion of the raised surface feature of the header member, the opening having a first width through the base wall and a second width through the raised surface feature that is less than the first width, such that a portion of the raised surface projects into the opening.

10. A heat exchanger manifold according to claim 9, further comprising a tube received in the opening so as to be in fluidic communication with the first and second passages.

11. A heat exchanger manifold according to claim 10, wherein the portion of the raised surface feature contacts the interior surface of the tank member, and the tube abuts the portion of the raised surface feature so as to be spaced apart from the interior surface of the tank member.

12. A heat exchanger manifold according to claim 10, further comprising a second opening through the header member, the second opening having a substantially constant width through the base wall and the raised surface feature, the tube abutting the interior surface of the tank member.

13. A heat exchanger manifold according to claim 9, further comprising at least one baffle within at least one of the passages.

14. A heat exchanger manifold according to claim 13, wherein the baffle is a raised surface feature defined on the interior surface of the tank member.

15. A heat exchanger manifold according to claim 13, wherein the baffle is a discrete member disposed within one of the first and second longitudinal channels of the header member and attached to the interior surface of the header member.

16. A heat exchanger manifold according to claim 13, further comprising a second opening through the header member, the baffle being an end portion of a tube inserted through the opening and abutting the interior surface of the tank member.

17. A heat exchanger manifold according to claim 9, wherein each of the passages has a semicircular cross-section.

18. A heat exchanger manifold according to claim 9, wherein the raised surface feature is metallurgically bonding to the interior surface of the tank member.

19. A heat exchanger manifold according to claim 9, wherein the tank member comprises a pair of oppositely-disposed lateral edges and the header member comprises means for clinching the lateral edges of the tank member.

20. A heat exchanger manifold according to claim 9, wherein the manifold is a component of a heat exchanger assembly, the heat exchanger assembly comprising a multiport tube having a first end received in the opening of the manifold and a second end fluidically connected to a second manifold.

* * * * *